US011466463B2

(12) United States Patent
Nielsen et al.

(10) Patent No.: US 11,466,463 B2
(45) Date of Patent: Oct. 11, 2022

(54) FABRIC MOUNTING SYSTEM AND METHOD OF MOUNTING AND EXTENDING FABRIC

(71) Applicant: Kvadrat Soft Cells A/S, Ebeltoft (DK)

(72) Inventors: Jesper Nielsen, Hamburg (DE); Michael Toldam Korsgard, Copenhagen S (DK)

(73) Assignee: KVADRAT SOFT CELLS A/S, Ebeltoft (DK)

( * ) Notice: Subject to any disclaimer, the term of this patent is extended or adjusted under 35 U.S.C. 154(b) by 0 days.

(21) Appl. No.: 17/040,018

(22) PCT Filed: Mar. 22, 2019

(86) PCT No.: PCT/EP2019/057300
§ 371 (c)(1),
(2) Date: Sep. 21, 2020

(87) PCT Pub. No.: WO2019/180233
PCT Pub. Date: Sep. 26, 2019

(65) Prior Publication Data

US 2021/0002905 A1 Jan. 7, 2021

(30) Foreign Application Priority Data

Mar. 23, 2018 (EP) ..... 18163731

(51) Int. Cl.
*E04F 13/00* (2006.01)

(52) U.S. Cl.
CPC ..... *E04F 13/005* (2013.01)

(58) Field of Classification Search
CPC ..... E04F 13/002; E04F 13/005; E04B 9/303
(Continued)

(56) References Cited

U.S. PATENT DOCUMENTS 6,324,797 B1 * 12/2001 Fago ..... E04B 9/306 160/327
6,574,936 B1 * 6/2003 Anderson, Sr. ..... B44C 1/28 52/100

(Continued)

FOREIGN PATENT DOCUMENTS

CN 1268988 A 10/2000
CN 1938486 A 3/2007

(Continued)

OTHER PUBLICATIONS

European Patent Office, International Search Report in International Application No. PCT/EP2019/057300 (dated Jun. 7, 2019) (4 pages).

(Continued)

*Primary Examiner* — Brian E Glessner
*Assistant Examiner* — James J Buckle, Jr.
(74) *Attorney, Agent, or Firm* — Neal, Gerber & Eisenberg LLP; Thomas E. Williams

(57) ABSTRACT

The fabric mounting system (1) includes a mounting profile (4) adapted to be mounted to a wall or ceiling and at least one fabric retaining element (5) engaging the mounting profile and being adapted to retain an edge (6) of the fabric (2). First and second supporting faces (9, 10) of the mounting profile (4) are mutually tapered in such a tapering direction (T) that a resilient bias of first and second legs (7, 8) of the fabric retaining element (5) urges the first and second legs (7, 8) to slide along the first and the second supporting faces (9, 10), respectively, to thereby displace the fabric retaining element in a direction generally against the tapering direction (T) and in a fabric tensioning direction (F) being transverse to a longitudinal direction (L) of the mounting profile (4) in order to stretch the fabric (2) in its retained position.

16 Claims, 6 Drawing Sheets

(58) Field of Classification Search
USPC ..... 52/63
See application file for complete search history.

(56) References Cited

U.S. PATENT DOCUMENTS

| | | | | |
|---|---|---|---|---|
| 8,074,411 | B1 * | 12/2011 | Anderson | E04F 13/005 52/222 |
| 8,959,854 | B1 * | 2/2015 | Bucklin | E04H 15/18 52/222 |
| 9,010,046 | B1 * | 4/2015 | Reilly | B44C 7/022 52/222 |
| 2007/0283656 | A1 * | 12/2007 | Anderson | E04F 13/005 52/506.06 |
| 2010/0116445 | A1 * | 5/2010 | Morris | E04F 13/005 160/327 |
| 2011/0061320 | A1 * | 3/2011 | Scherrer | E04F 13/005 52/222 |
| 2012/0180421 | A1 * | 7/2012 | Weithaller | E04F 13/005 52/588.1 |
| 2017/0067254 | A1 * | 3/2017 | Scherrer | E04B 9/0435 |
| 2019/0309522 | A1 * | 10/2019 | Scherrer | E04F 13/005 |
| 2020/0002953 | A1 * | 1/2020 | Geis | E04B 9/0435 |
| 2020/0277794 | A1 * | 9/2020 | Kouijzer | E04F 13/005 |
| 2021/0032871 | A1 * | 2/2021 | Bubernak | E04F 13/005 |

FOREIGN PATENT DOCUMENTS

| | | | |
|---|---|---|---|
| CN | 107109844 | A | 8/2017 |
| DE | 202009005753 | | 4/2009 |
| EP | 0043466 | | 1/1982 |
| FR | 2317537 | | 2/1997 |
| JP | 2010268736 | | 12/2010 |
| KR | 100932957 | | 12/2009 |
| KR | 20100076101 | | 7/2010 |
| KR | 20110084719 | | 7/2011 |
| NL | 2015439 | | 4/2017 |
| RU | 93422 | U1 | 4/2010 |
| WO | 1988/003231 | | 5/1988 |
| WO | 1999/024722 | | 5/1999 |
| WO | 2004/661251 | | 7/2004 |
| WO | 2004061251 | A1 | 7/2004 |
| WO | 2017/083181 | | 5/2017 |
| WO | 2019/180233 | | 9/2019 |

OTHER PUBLICATIONS

European Patent Office, Written Opinion of The International Searching Authority in International Application No. PCT/EP2019/057300 (dated Jun. 7, 2019) (6 pages).
Office Action issued in Chinese Application No. 201980021307.0 dated Nov. 3, 2021 (13 pages).
Office Action issued in Chinese Application No. 201980021307.0 dated Feb. 14, 2022 (7 pages).
International Preliminary Report on Patentability issued in International Application No. PCT/EP2019/057300 dated Jul. 2, 2020 (22 pages).

* cited by examiner

FABRIC MOUNTING SYSTEM AND METHOD OF MOUNTING AND EXTENDING FABRIC

The present invention relates to a fabric mounting system adapted to extend a fabric covering at least a part of a wall or ceiling, including at least a first mounting profile having a longitudinal direction and being adapted to be mounted to the wall or ceiling and at least one first fabric retaining element engaging the first mounting profile and being adapted to retain an edge of the fabric, the first fabric retaining element having a first leg and a second leg being resiliently biased in relation to each other so that the first leg is urged against a first supporting face of the first mounting profile and the second leg is urged against a second supporting face of the first mounting profile.

NL2015439 B1 discloses a system for stretching or mounting a flexible sheet, comprising a rail defining an elongated receiving space, and an elongated wedge shaped locking member for clamping a sheet portion between said locking member and the rail. The system is arranged such that, within the receiving space, the locking member can at least partly tilt from a first end position, in which its first outer side surface is substantially parallel with and/or substantially abuts a first wall surface of the receiving space and in which its second outer side surface is substantially spaced away from a second wall surface opposite the first wall surface, towards a second end position, in which the second locking member outer side surface is substantially parallel with and/or substantially abuts the second wall surface and in which the first locking member outer side surface is substantially spaced away from the first wall surface. Thereby, the locking member may be pivoted from its first end position, i.e. a locking position, towards its second end position, via an intermediate position in which each of the two outer side surfaces of the locking member, and/or sheet material surrounding the locking member, are/is substantially placed away from the respective wall surface, so that the sheet material may be moved or passed about the locking member within the receiving space in a relatively easy manner. The first and second wall surfaces of the receiving space are parallel, and the first and second outer side surfaces of the locking member taper and thereby form the wedge-shape of the locking member. Whereas this system facilitates adjustment of the flexible sheet in order to stretch the sheet appropriately during the mounting procedure, it may be a disadvantage that the system does not ensure that the flexible sheet is maintained properly stretched. Therefore, if the flexible sheet and/or the rails on which it is mounted may change dimensions for instance due to temperature changes or due to other circumstances, for instance if the rails happen to be slightly deformed as a result of handling or the like, the flexible sheet may lose its tension and the appearance may be compromised. Furthermore, if the flexible sheet is not of an elastic nature, it may be difficult or even impossible to maintain proper tensioning of the sheet by means of this system.

DE 20 2009 005 753 U1 discloses a similar mounting system for a fabric or the like. The system is composed of a base moulding and a clamping member. The base moulding forms a receiving space having parallel support faces for the clamping member. The clamping member is V-formed with two elastic legs which are pressed towards each other when the clamping member is inserted into the receiving space. The fabric to be mounted is arranged loosely on top of the clamping member before insertion of the clamping member into the receiving space so that the fabric is pinched between the legs of the clamping member and the parallel support faces of the receiving space when the clamping member is inserted into the receiving space. The clamping member is inserted into the receiving space with the top of its V-form first whereby a spatula or the like may be arranged between the two legs of the clamping member and may be used to press the clamping member into the receiving space. One leg of the clamping member abuts a protrusion of the receiving space in the mounted position of the clamping member so that the clamping member is retained in its mounted position. By pulling the edge of the fabric or the like extending from said leg, the legs of the clamping member may be pressed towards each other whereby it is possible to demount the clamping member and the fabric from the base moulding again. However, by means of this system, for the same reasons as explained just above, it may be difficult or even impossible, at least in the long term, maintaining proper tensioning of the fabric or sheet.

JP2010268736 A discloses a film fastener used in a film roof structure. The film fastener includes a film attachment member and an insertion member adapted to fix the film to the film attachment member by insertion of the insertion member into a channel formed in the film attachment member. The insertion member is V-formed with the top of its V-form being inserted firstly into the channel and pointing into the channel in the insertion direction when mounted. At the opening of the channel, a protrusion is arranged on which a free end of one of the legs of the insertion member rests in the mounted position of the insertion member, thereby retaining the insertion member in the channel. In an embodiment, the side walls of the channel taper in the insertion direction of the channel. However, by means of this system, for the same reasons as explained just above, it may be difficult or even impossible, at least in the long term, maintaining proper tensioning of the fabric or sheet.

KR101018730 B1 discloses a stretch sheet installation structure of a lighting apparatus. The sheet is provided at its edges with a fastening member which is permanently fixed to the sheet, for instance by means of welding or gluing. The fastening member is V-formed with two elastic legs which are pressed towards each other when inserted into a channel of a fastening profile. The channel is tapering in the insertion direction of the fastening member and the V-form of the fastening member is also tapering in the insertion direction when the fastening member is arranged in the channel of the fastening profile. One of the legs of the fastening member has a recess engaging a protrusion of the channel when the fastening member is arranged in the channel so that the fastening member is retained in the channel. However, by means of this system, for the same reasons as explained just above, it may be difficult or even impossible, at least in the long term, maintaining proper tensioning of the fabric or sheet. Furthermore, it may be a disadvantage that the stretch sheet has to be provided with permanently fixed fastening members at its edges as this may result in a complicated mounting procedure.

KR100932957 B1 discloses an installation structure of a ceiling finishing sheet provided to keep a non-ductile sheet tight. The sheet is provided at its edges with a fastening member which is permanently fixed to the sheet, for instance by means of welding or gluing. The fastening member has two elastic legs which are pressed towards each other when inserted into a channel of a fastening profile. The channel has two opposed and parallel support faces for the respective legs of the fastening member. A free end of one leg of the fastening member abuts a protrusion of the channel in the mounted position of the fastening member so that the fastening member is retained in its mounted position in the channel. In an embodiment, the free end of said leg of the fastening member may abut a number of different indentations formed regularly on the corresponding support face of the channel in the insertion direction of the fastening member. The indentations form smaller support wall parts each of which forms a tapering relation to the opposed support face of the channel in the insertion direction of the fastening member. Thereby, the non-ductile sheet may be tightened by appropriate positioning of the fastening member. However, by means of this system, for the same reasons as explained above, it may be difficult or even impossible, at least in the long term, maintaining proper tensioning of the fabric or sheet. Furthermore, it may be a disadvantage that the sheet has to be provided with permanently fixed fastening members at its edges as this may result in a complicated mounting procedure.

EP 0 043 466 A2 discloses a clamp-in ceiling design with an at least partially resilient sheet, to the edge region of which a clamping flange is fixed which is made of plastic and can be inserted into and positively anchored in a groove of a wall strip located on the wall. The clamping flange has a virtually anchor-shaped cross-section and accordingly comprises a central web permanently fixed to the sheet, an upper holding bead and a lower holding bead. The groove being is provided with at least one upper or one lower ring shoulder and the two holding beads of the clamping flange are shaped in such a way that, on insertion into the groove of the wall strip, they are deformed and assume their anchored position inside the groove. However, by means of this system, for the same reasons as explained above, it may be difficult or even impossible, at least in the long term, maintaining proper tensioning of the fabric or sheet. Furthermore, it may be a disadvantage that the sheet has to be provided with permanently fixed fastening members at its edges as this may result in a complicated mounting procedure.

WO 2004/061251 A1 discloses a fabric-retaining structure including a body and a fabric-gripping jaw arrangement coupled to the body. The jaw arrangement includes a crenated jaw having crenated teeth and a serrated jaw having serrated teeth. The crenated jaw is arranged in opposition to the serrated jaw. However, by means of this system, it may be difficult or even impossible, at least in the long term, maintaining proper tensioning of the fabric or sheet.

WO 2017/083181 A1 discloses a ceiling system including a ceiling structure suspended in an interior space and incorporating a fabric-retaining structure of the type described just above.

KR 2011 0084719 A relates to mounting of a stretch sheet at a ceiling. The stretch sheet is made of a material being elastic and resilient and is provided at its edges with a fastening member fixed to the sheet and has two elastic legs which are pressed towards each other when inserted into a channel of a fastening profile. The channel has a first support face and a second support face for abutment of the respective legs of the fastening member in the mounted position of the fastening member. The first and second support faces are parallel. The first support face is provided with a downwardly extending oblique part having an edge supporting the sheet in its extended position. In its retained position in the channel of the fastening profile, the fastening member is maintained in a fixed position in that a fixing protrusion of the second support face engages a groove on the second leg of the fastening member.

WO 99/24722 discloses a sheet material securing fastener comprising fork means arranged to be mounted to a fixture, said fork means having at least two arms joined by junction means, said arms spaced apart at a region spaced from said junction means, and keeper means being substantially resilient and insertable into said fork means to hold a portion of sheet material between said keeper means and said fork means. Furthermore, tension control means are provided to enable tensile force in said sheet material to be controlled by repositioning said keeper means in said fork means.

WO 88/03231 discloses a fastening means for sheeting material comprising a fork member to be mounted to a fixture, said fork member having a pair of outwardly diverging arms, one arm being provided within inwardly directed hook means distally disposed therealong relative to the junction between the arms, and a keeper member to be disposed within the fork member between the arms and being capable of adopting a locking position between the arms.

FR 2 317 537 discloses a long insert retaining a sheet material in a C-shaped section of a support. The insert is itself C-shaped having one long and one short flange, joined by a bent web. The short flange is curved inwards towards the long flange as is that of the support edge towards its corresponding web. The width of the insert across the flanges is made at least equal to the minimum inside gap between the support flange and web, the insert retaining the flexible material when assembled. The material is placed in position across the support section and pressed down into the groove by the short flange of the insert. The latter is then rotated until its long flange comes up against the web of the support.

The object of the present invention is to provide a simple fabric mounting system whereby any length of fabric or sheet may easily be mounted and extended at a wall or ceiling and whereby proper tensioning of the fabric or sheet is ensured on a long term basis.

In view of this object, the first and the second supporting faces of the first mounting profile are mutually tapered in such a tapering direction that the resilient bias of the first and second legs of the first fabric retaining element urges the first and second legs to slide along the first and the second supporting faces, respectively, to thereby displace the first fabric retaining element in a direction generally against the tapering direction and in a fabric tensioning direction being transverse to the longitudinal direction of the first mounting profile in order to stretch the fabric in its retained position.

In this way, in the retained position of the fabric, the first fabric retaining element is able to travel generally oppositely the tapering direction and in the fabric tensioning direction under the influence of the resilient bias of the first and second legs of the first fabric retaining element, in the case that the initial tension of the fabric should decrease, for instance as a result of a slight deformation of the mounting profile. On the other hand, should the tension of the fabric increase, for instance as a result of something being unintentionally pressed against the surface of the stretched fabric, the first fabric retaining element may travel in the opposite direction of the fabric tensioning direction against the resilient bias of the first and second legs of the first fabric retaining element. Thereby, an appropriate tensioning of the fabric may be ensured permanently during the lifetime of the product.

In an embodiment, the first fabric retaining element is displaceable in a direction generally against the tapering direction from a fabric attachment position in which the first fabric retaining element is releasably retained in the first mounting profile to a fabric tensioning position in which the force of the tensioned fabric in the retained position of the fabric balances the resilient bias of the first and second legs of the first fabric retaining element which urges the first fabric retaining element to slide in the direction generally against the tapering direction and in the fabric tensioning direction. Thereby, the fabric may be attached to the mounting profile by means of the first fabric retaining element without applying much tension to the fabric, and subsequently, the first fabric retaining element may be released from the fabric attachment position in order to apply a relatively high tension to the fabric whereby the fabric may be stretched properly. It may be easier mounting and arranging the fabric correctly, for instance by adjusting the length of the fabric, without applying a high tension immediately. Furthermore, in this way, it may be possible to obtain a relatively higher tensioning force of the fabric.

In a structurally particularly advantageous embodiment, the first fabric retaining element is releasably retained in the fabric attachment position in that a free end of the first or the second leg of the first fabric retaining element abuts a recess of the first mounting profile. Thereby, the first fabric retaining element may easily be released from the fabric attachment position by pressing on the leg of the first fabric retaining element abutting said recess of the first mounting profile so that the free end of the leg is displaced away from said recess.

In an embodiment, the first fabric retaining element is adapted to retain a first edge of the fabric by pinching the first edge of the fabric between the first fabric retaining element and the first mounting profile. Thereby, the length of the fabric may easily be customised to the size of the wall or ceiling, because the fabric may be cut to length and mounted correctly in the fabric mounting system during the mounting procedure, whereby the correct positioning of the fabric may be adjusted steplessly by pressing a first edge of the fabric in between the first fabric retaining element and the first mounting profile.

In a structurally particularly advantageous embodiment, the first fabric retaining element is adapted to retain a first edge of the fabric by pinching the first edge of the fabric between the first or the second leg of the first fabric retaining element and the corresponding first or second supporting face of the first mounting profile.

In an embodiment, the first and the second supporting faces of the first mounting profile face each other. Thereby, the first fabric retaining element may advantageously be at least partly hidden between the first and the second supporting faces.

In an embodiment, the first and the second supporting faces of the first mounting profile are formed by a first and a second side wall, respectively, of a channel in which the first fabric retaining element is retained in the first mounting profile. Thereby, the first fabric retaining element may advantageously be at least partly hidden in the channel.

In an embodiment, the first and the second side wall of the channel of the first mounting profile extend from a bottom wall of the channel, and the first side wall of the channel extends further away from the bottom wall than the second side wall of the channel and forms a rounded edge adapted to guide the fabric at a free edge of the first side wall. Thereby, the fabric may be extended in another direction than the fabric tensioning direction resulting from the geometry of the channel. For instance, the fabric may be extended in parallel with the wall or ceiling, and the channel may be arranged at least partly hidden behind the fabric.

In an embodiment, the first side wall of the channel forms an acute angle in relation to the bottom wall of the channel. Thereby, if the bottom wall is mounted in parallel with the wall or ceiling, it may be possible to even better hide the channel behind the fabric.

In an embodiment, the first fabric retaining element is substantially V-formed and forms a bent edge connecting its first and second legs, both the bent edge and a free end of the first leg abut the first supporting face of the first mounting profile and thereby are adapted to pinch the first edge of the fabric against the first supporting face, and a free end of the second leg abuts the second supporting face of the first mounting profile. Thereby, the first edge of the fabric may be even better retained by means of the pinching action, because both the bent edge and the free end of the first leg may contribute to the pinching action.

In a structurally particularly advantageous embodiment, the fabric tensioning direction is directed at least substantially from the bent edge in the direction of the free end of the first leg.

In an embodiment, the first leg of the first fabric retaining element is curved away from the first supporting face of the first mounting profile between its free end and the bent edge. Thereby, a particularly advantageous pinching effect may be obtained by the free end of the first leg abutting the first supporting face with the fabric therebetween, because the free end of the first leg may form an acute angle in relation to the fabric on the first supporting face, thereby creating a concentrated relatively high pressure acting on a relatively small area in the form of the edge of the free end of the first leg.

In an embodiment, the first leg of the first fabric retaining element is longer than the second leg of the first fabric retaining element. Thereby, the first fabric retaining element may suitably balance itself in an advantageous, stable position in the channel of the first mounting profile so that both the bent edge and the free end of the first leg abut the first supporting face of the first mounting profile with the fabric therebetween so that the first edge of the fabric is pinched strongly against the first supporting face.

In an embodiment, the second leg of the first fabric retaining element is curved away from the second supporting face of the first mounting profile between its free end and the bent edge. Thereby, it may be ensured that a free end of the second leg may abut the second supporting face at an appropriate angle and thereby easier slide along the second supporting face, thereby improving the self-tensioning effect of the mounting system.

In a structurally particularly advantageous embodiment, the at least one first fabric retaining element has the form of a leaf spring having a longitudinal direction extending in the longitudinal direction of the first mounting profile and having a first longitudinal flange forming the first leg and a second longitudinal flange forming the second leg, and the first longitudinal flange and the second longitudinal flange are connected along a bent edge.

In an embodiment, a number of mutually spaced cut-outs are formed in the bent edge of the leaf spring. Thereby, in particular in the case that the leaf spring is relatively long, the cut-outs may impart a certain flexibility to the leaf spring, thereby facilitating the release of the leaf spring from its fabric attachment position, for instance by pressing the first longitudinal flange in the direction of the second longitudinal flange so that the first longitudinal flange jumps out of abutment with a suitable recess in the first mounting profile. An ability of the leaf spring to twist about its longitudinal axis may advantageously facilitate this operation.

The present invention further relates to a method of mounting and extending a fabric covering at least a part of a wall or ceiling, the method including the steps of mounting at least a first mounting profile having a longitudinal direction on the wall or ceiling and, in a fabric attachment position of a first fabric retaining element, pinching a first edge of the fabric between the first fabric retaining element and the first mounting profile, the first fabric retaining element engaging the first mounting profile and having a first leg and a second leg being resiliently biased in relation to each other so that the first leg is urged against a first supporting face of the first mounting profile and the second leg is urged against a second supporting face of the first mounting profile.

The method is characterised by releasing the first fabric retaining element from its fabric attachment position so that the resilient bias of the first and second legs of the first fabric retaining element urges the first fabric retaining element to slide along the first and the second supporting faces in a direction generally against the tapering direction and in a fabric tensioning direction being transverse to the longitudinal direction of the first mounting profile so that the fabric is stretched.

The invention will now be explained in more detail below by means of examples of embodiments with reference to the very schematic drawing, in which FIG. 1 is a cross-sectional view through a first embodiment of a fabric mounting system according to the invention;

Figure 1:
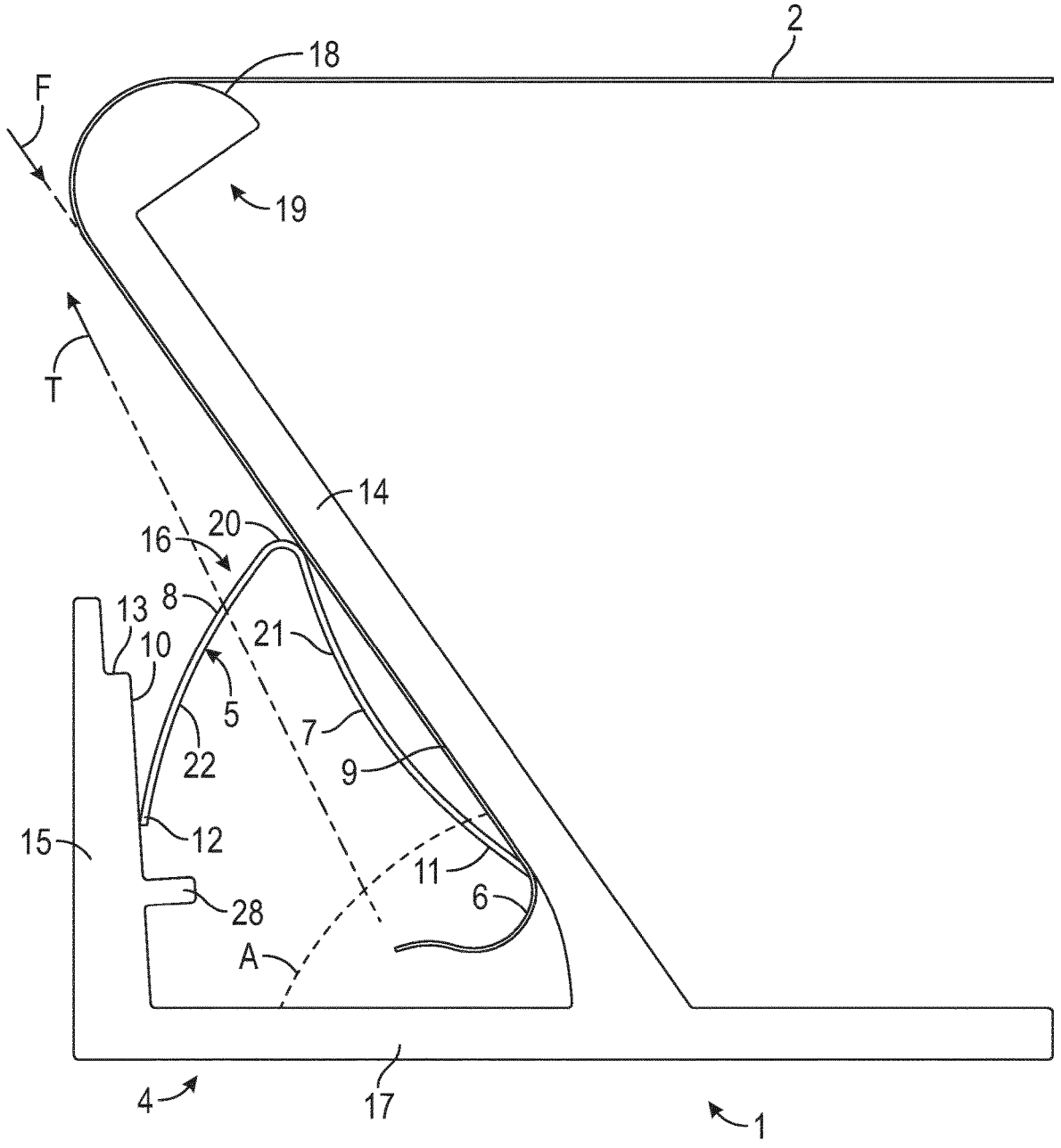

FIG. 1 shows an embodiment of a fabric mounting system 1 according to the invention by means of which a fabric 2 or textile is extended. As illustrated in FIGS. 3A to 3D, the fabric 2 may cover a wall or ceiling 3. It is noted that in the figures, for illustration purposes, the fabric 2 is illustrated extending above the wall or ceiling 3, whereas, in the case of a ceiling being covered, the fabric would of course be arranged below the wall or ceiling 3.

Figure 2:
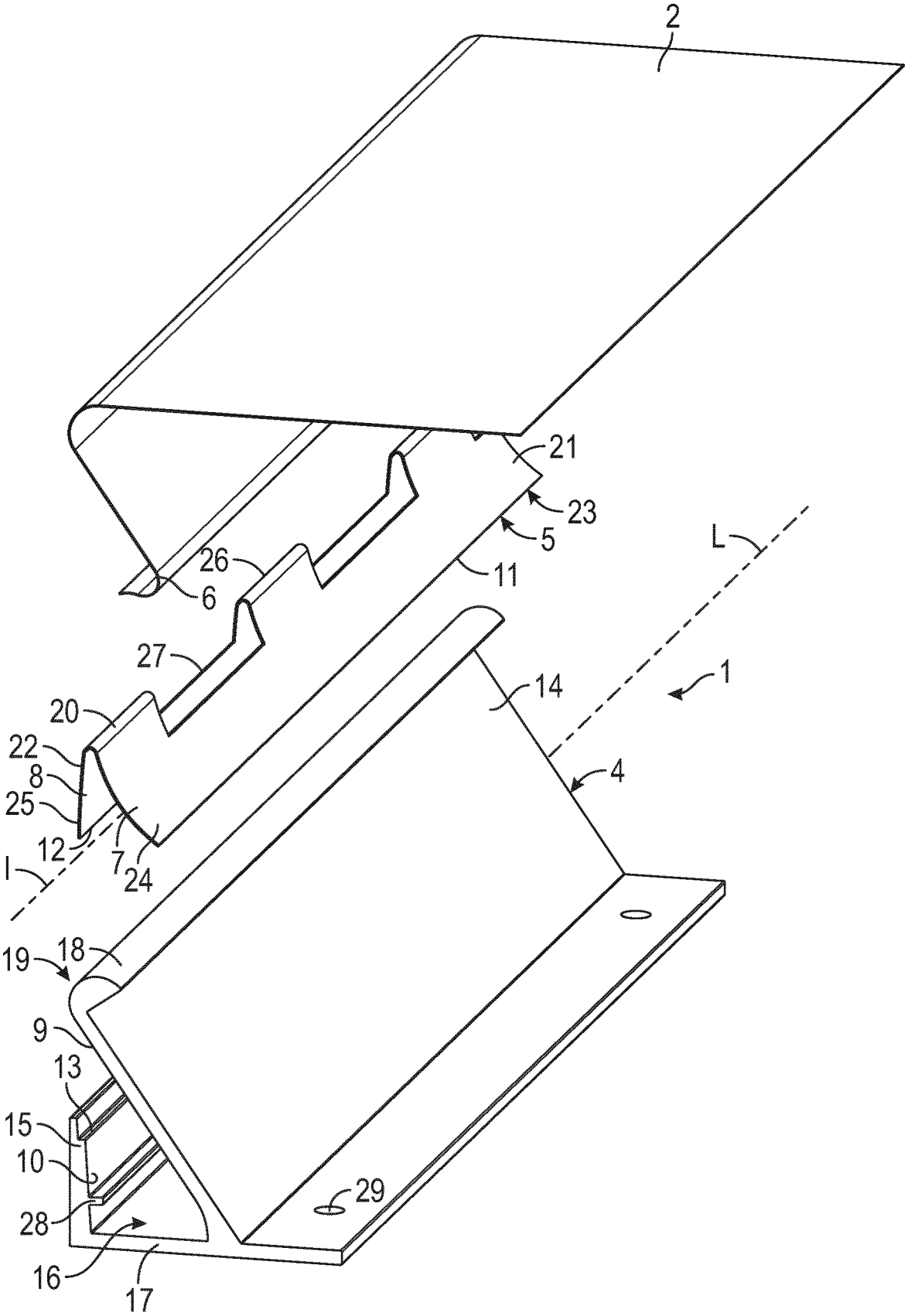
FIG. 2 is an exploded, perspective view of the fabric mounting system in FIG. 1.

The fabric mounting system 1 includes at least a first mounting profile 4 having a longitudinal direction Las illustrated in FIG. 2 and being adapted to be mounted to the wall or ceiling 3 as illustrated in FIGS. 3A to 3D by means of mounting screws inserted through mounting holes 29 in the first mounting profile 4. The longitudinal direction L may be straight or curved. The first mounting profile 4 could alternatively be mounted to the wall or ceiling 3 by any other suitable means such as nails or adhesive, possibly in combination. The fabric mounting system 1 furthermore includes at least one first fabric retaining element 5 engaging the first mounting profile 4 and being adapted to retain a first edge 6 of the fabric 2. The first fabric retaining element 5 has a first leg 7 and a second leg 8 being resiliently biased in relation to each other so that the first leg 7 is urged against a first supporting face 9 of the first mounting profile 4 and the second leg 8 is urged against a second supporting face 10 of the first mounting profile 4.

The first and the second supporting faces 9, 10 of the first mounting profile 4 are mutually tapered in such a tapering direction T that the resilient bias of the first and second legs 7, 8 of the first fabric retaining element 5 urges the first and second legs 7, 8 to slide along the first and the second supporting faces 9, 10, respectively, to thereby displace the first fabric retaining element in a direction generally against the tapering direction and in a fabric tensioning direction F being transverse to the longitudinal direction L of the first mounting profile 4 in order to stretch the fabric 2 in its retained position as illustrated in FIG. 1. It is understood that, because the first fabric retaining element 5 deforms during its displacement, which in the embodiment of FIG. 1 means that its first and second legs 7, 8 bend away from each other, an accurate direction of displacement of the first fabric retaining element 5 is not defined in the figures. Rather, it is understood that when the first fabric retaining element 5 is displaced in a direction generally against the tapering direction T and in the fabric tensioning direction F, it is meant that the first fabric retaining element 5 is generally as a whole displaced at least substantially in a direction which is opposed to the tapering direction T, but at least a part of the fabric retaining element 5 is displaced in the fabric tensioning direction F. In the embodiment of FIG. 1, it is seen that said part of the fabric retaining element 5 is the first leg 7 which is displaced in the fabric tensioning direction F.

Preferably, and as illustrated in the embodiments of FIGS. 1 to 5, the first fabric retaining element 5 is displaceable in a direction generally against the tapering direction T from a fabric attachment position as illustrated in FIGS. 3B, 3C, 4A and 5A in which the first fabric retaining element 5 is releasably retained in the first mounting profile 4 to a fabric tensioning position as illustrated in FIGS. 1, 3D, 4B and 5B in which the force of the tensioned fabric 2 in the retained position of the fabric balances the resilient bias of the first and second legs 7, 8 of the first fabric retaining element 5 which urges the first fabric retaining element 5 to slide in the direction generally against the tapering direction and in the fabric tensioning direction F.

Figure 6:
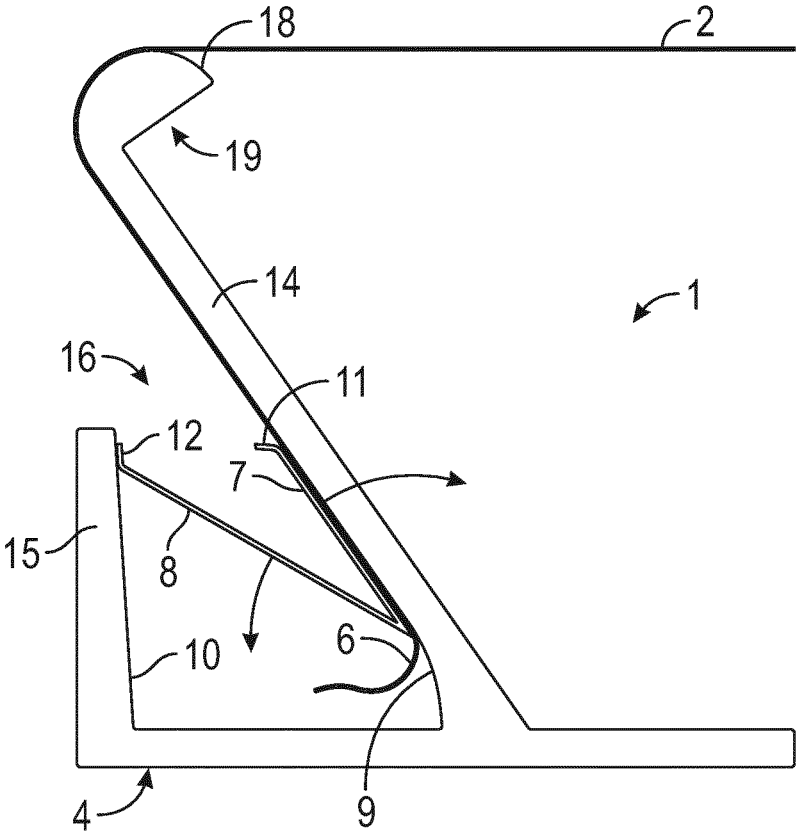
FIG. 6 is a cross-sectional view of a fourth embodiment of the fabric mounting system according to the invention.
Figure 7:
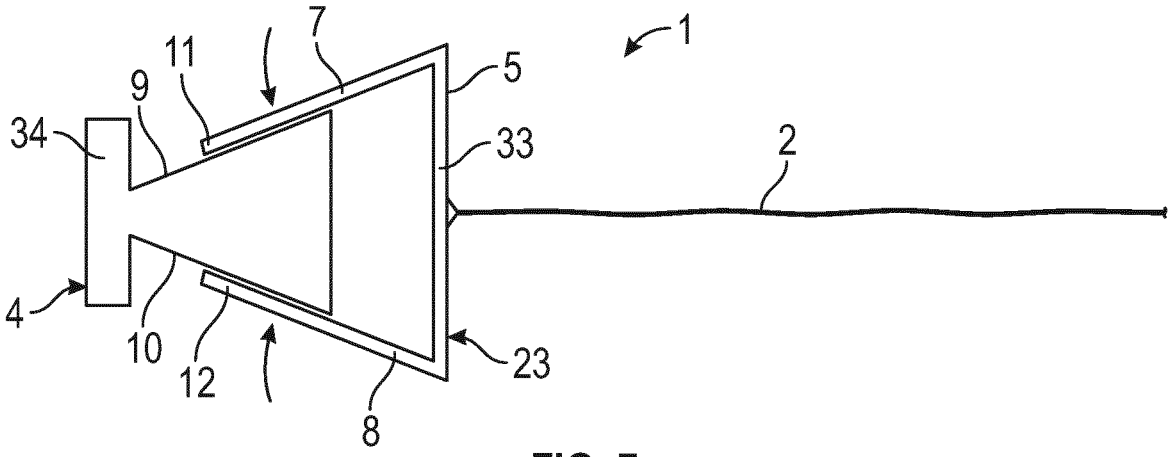
FIG. 7 is a cross-sectional view of a fifth embodiment of the fabric mounting system according to the invention.

On the other hand, in the embodiments according to the invention illustrated in FIGS. 6 and 7, the first fabric retaining element 5 is not retainable in a fabric attachment position. Rather, in the embodiment of FIG. 6, the first fabric retaining element 5 may simply be inserted into the channel 16 of the first mounting profile 4, in which the first edge 6 of the fabric 2 has been arranged, whereby it pinches the first edge 6 of the fabric 2 and at the same time stretches the fabric 2 by displacing itself in the fabric tensioning direction F corresponding to that illustrated in FIG. 1. In the embodiment of FIG. 7, the first edge 6 of the fabric 2 has been attached to the first fabric retaining element 5 by any suitable means as explained above, and subsequently, the first fabric retaining element 5 has been arranged gripping over the first mounting profile 4 as illustrated, either by deforming the legs 7 and 8 of the first fabric retaining element 5 or by sliding the first fabric retaining element 5 over the first mounting profile 4 from an end thereof. By suitable length of the fabric in the fabric tensioning direction and suitable positioning of the first mounting profile 4, the first fabric retaining element 5 may be arranged on the first mounting profile 4 approximately as illustrated in the figure, whereby a tensioning force may be provided in the fabric 2 by means of the elastic bias of the first and second legs 7, 8 pressing on the tapering first and second supporting faces 9, 10, respectively.

Preferably, the fabric mounting system 1 includes a not shown second mounting profile to be arranged and mounted to the wall or ceiling 3 at a distance from the first mounting profile 4 and preferably symmetrically in relation to the first mounting profile about a plane extending perpendicularly in relation to the fabric 2 which plane in FIG. 1 would be a vertical plane. In this case, the fabric mounting system 1 furthermore includes at least one second fabric retaining element engaging the second mounting profile and being adapted to retain a second edge of the fabric 2 in the same way as illustrated in FIG. 1 for the first mounting profile 4 and the first fabric retaining element 5. In this case, the second edge of the fabric 2 may be opposed to the first edge 6 of the fabric 2. Nevertheless, according to the present invention, a second mounting profile corresponding to the first mounting profile is not necessary, because the fabric 2 may be mounted at one or more other of its edges to the wall or ceiling 3 by means of other and possibly simpler mounting means and still be stretched only by means of the tensioning action of the first fabric retaining element 5. For instance, such other edges of the fabric 2 may simply be attached to the wall or ceiling 3 by means of staples. Because the first fabric retaining element 5 is urged to slide in the fabric tensioning direction F of the first mounting profile 4, the fabric 2 is stretched in its retained position independently of how the opposed second edges of the fabric 2 is mounted to the wall or ceiling 3.

It is also possibly that the first and second mounting profiles may be arranged at either side of a corner of a building, whereby the fabric may extend around the corner where it may be supported preferably by means of a rounded edge, for instance provided on a profile mounted to the wall or ceiling at the corner.

The fabric mounting system 1 may include four corresponding mounting profiles each including at least one fabric retaining element and together forming a frame by means of which a rectangular piece of fabric may be retained. The mounting profiles may be connected at corners by means of not shown, suitable corner pieces forming a smooth transition for the fabric to be extended. In the same way, any suitable number of corresponding mounting profiles each including at least one fabric retaining element may together form a frame by means of which a corresponding piece of fabric may be retained. For example, the frame may have the form of a pentagon, a hexagon or any other suitable polygon. Furthermore, the mounting profile or profiles may also be curved whereby the corresponding fabric retaining element or elements may be correspondingly curved. For instance, one mounting profile may form a circle, an oval or other closed form in order to extend a correspondingly formed piece of fabric.

It may be an advantage according to the present invention that the fabric mounting system 1 as illustrated in the figures may be sold as one or a number of lengths of a first mounting profile 4 with corresponding one or more first fabric retaining element or elements. On the building site, the length of the first mounting profile 4 may be cut into suitable sizes of mounting profile corresponding to the actual dimensions of the building in or on which the fabric 2 is to be extended. In this way, an extended fabric may be arranged in a tailor-made fashion to fit a room of a building. In the case that the first fabric retaining element 5 is adapted to have the same length as the first mounting profile 4, the first fabric retaining element may correspondingly be cut into suitable sizes. Alternatively, the first fabric retaining element may be provided as a number of fabric retaining elements each having a shorter length than the length of the first mounting profile 4 and being adapted to be positioned one after the other in the longitudinal direction L of the mounting profile.

Figure 3A:
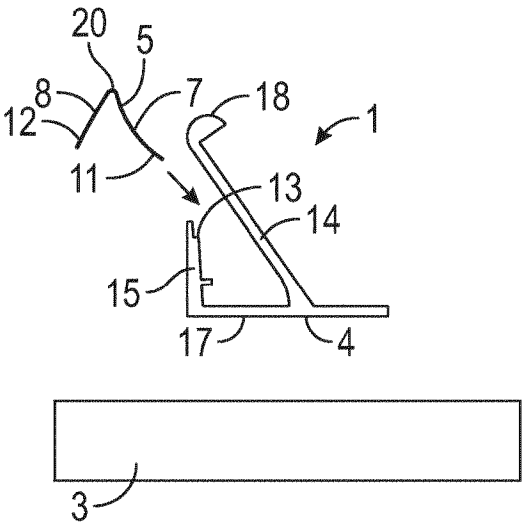
FIGS. 3A to 3D illustrate different steps of the mounting procedure whereby a fabric may be extended by means of the fabric mounting system in FIG. 1.
Figure 3B:
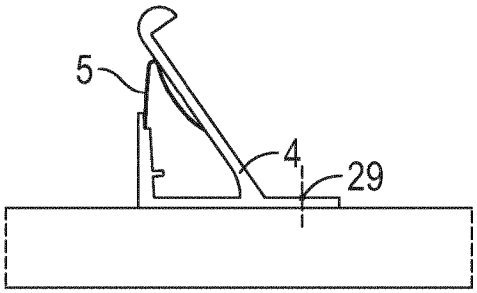

The first mounting profile 4 may be sold with the corresponding one or more first fabric retaining element 5 or elements already mounted in the fabric attachment position as illustrated in FIG. 3B, and the first mounting profile 4 and the corresponding first fabric retaining element 5 may be cut to length as one unit.

As illustrated in FIG. 3A, the first mounting profile 4 may alternatively be provided with the corresponding one or more first fabric retaining element 5 or elements separately, and these elements may then be assembled during the mounting procedure, whereby the first mounting profile 4 is mounted to the wall or ceiling 3.

As an alternative to mounting the mounting profiles separately on a wall or ceiling at the building site, it is also possible to provide panels which are ready to mount on a ceiling or wall, whereby the panels are composed by mounting profiles arranged to form a frame and provided with fabric stretched over the panel by means of fabric retaining elements arranged in the mounting profiles according to the invention and as described herein.

In the embodiments illustrated in FIGS. 1 to 6, the first fabric retaining element 5 is adapted to retain the first edge 6 of the fabric 2 by pinching the first edge 6 of the fabric 2 between the first fabric retaining element 5 and the first mounting profile 4. Furthermore, in these embodiments, the first fabric retaining element 5 is adapted to retain the first edge 6 of the fabric 2 by pinching the first edge 6 of the fabric 2 between the first leg 7 of the first fabric retaining element 5 and the corresponding first supporting face 9 of the first mounting profile 4.

On the other hand, in the embodiment illustrated in FIG. 7, the first fabric retaining element 5 is adapted to retain the first edge 6 of the fabric 2 by means of a simple connection between the first edge 6 and the first fabric retaining element 5. Said connection may for instance be formed by means of thread sewed through holes in the first fabric retaining element 5 and the first edge 6, respectively. However, any suitable means of connection is possible.

In addition, it is seen that in the embodiments illustrated in FIGS. 1 to 6, the first and the second supporting faces 9, 10 of the first mounting profile 4 face each other in that the first and the second supporting faces 9, 10 of the first mounting profile 4 are formed by a first and a second side wall 14, 15, respectively, of a channel 16 in which the first fabric retaining element 5 is retained in the first mounting profile 4. The first and the second side wall 14, 15 of the channel 16 of the first mounting profile 4 extend from a bottom wall 17 of the channel 16, and the first side wall 14 of the channel 16 extends further away from the bottom wall 17 than the second side wall 15 of the channel 16 and forms a rounded edge 18 adapted to guide the fabric 2 at a free edge 19 of the first side wall 14. It should be noted that the illustrated rounded edge 18 may of course be dispensed with if such guidance is not needed and in which case the channel 16 may simply be directed in the direction of the general plane of the fabric 2 when extended along a wall or ceiling.

As illustrated in FIG. 3B, the first fabric retaining element 5 may be positioned in a fabric attachment position in which the first fabric retaining element 5 is releasably retained in the first mounting profile 4. In the embodiment illustrated in FIGS. 1 to 3, the first fabric retaining element 5 is releasably retained in the fabric attachment position in that a free end 12 of the second leg 8 of the first fabric retaining element 5 abuts a recess 13 of the first mounting profile 4. The recess 13 is formed in the second side wall 15 of the channel 16 of the first mounting profile 4. By pressing on the second leg 8 of the first fabric retaining element 5, the second leg 8 may jump out of the recess 13 whereby the first fabric retaining element 5 is released from the fabric attachment position.

Figure 4A:
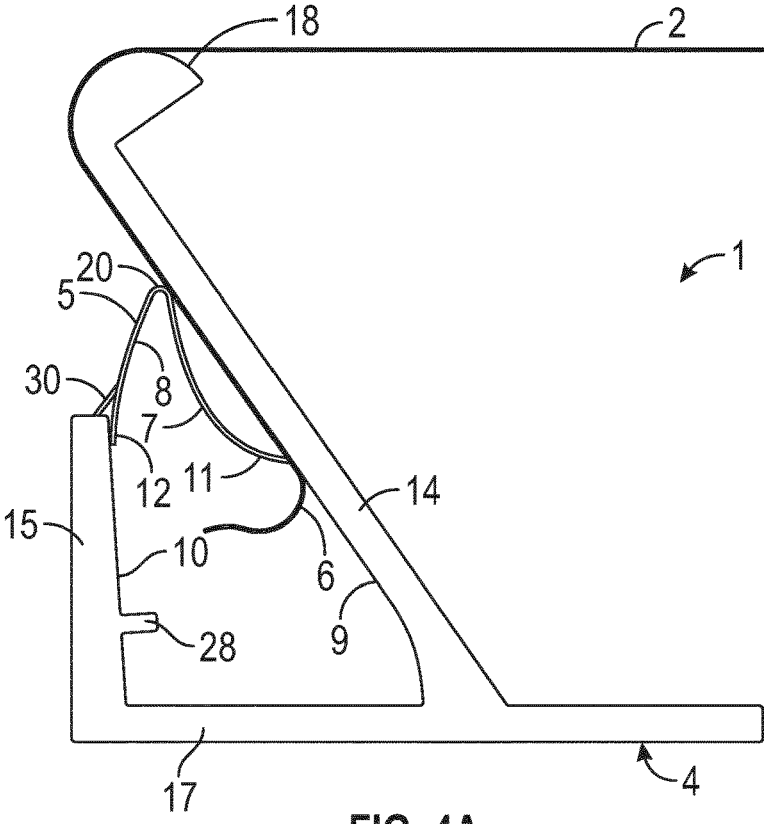
FIGS. 4A and 4B illustrate different steps of the mounting procedure whereby a fabric may be extended by means of a second embodiment of the fabric mounting system according to the invention.
Figure 4B:
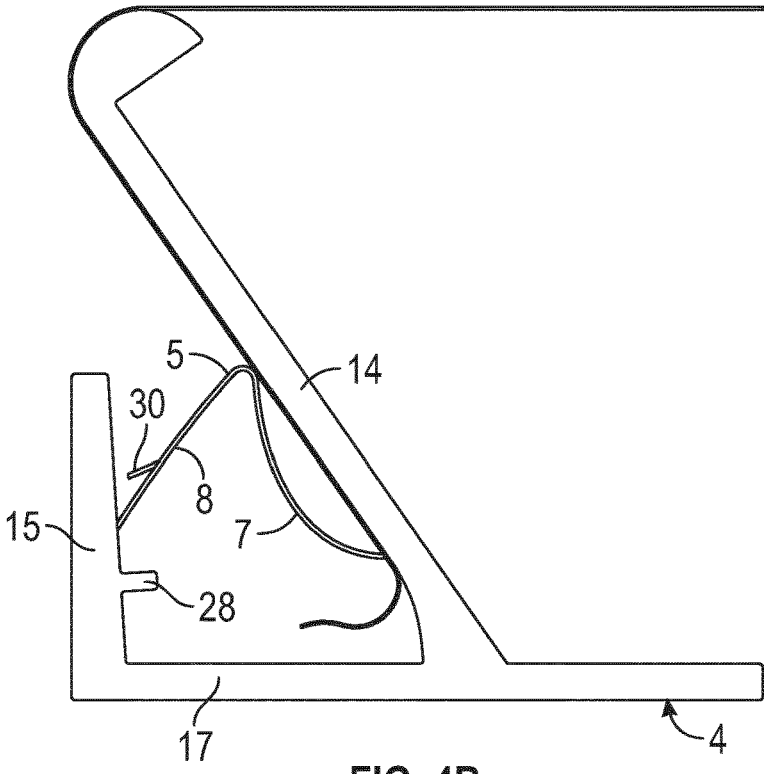

In the embodiment illustrated in FIGS. 4A and 4B, the first fabric retaining element 5 is releasably retained in the fabric attachment position in that a bent-out flap 30 of the second leg 8 of first fabric retaining element 5 abuts a free end of the second side wall 15 of the channel 16 of the first mounting profile 4.

Figure 5A:
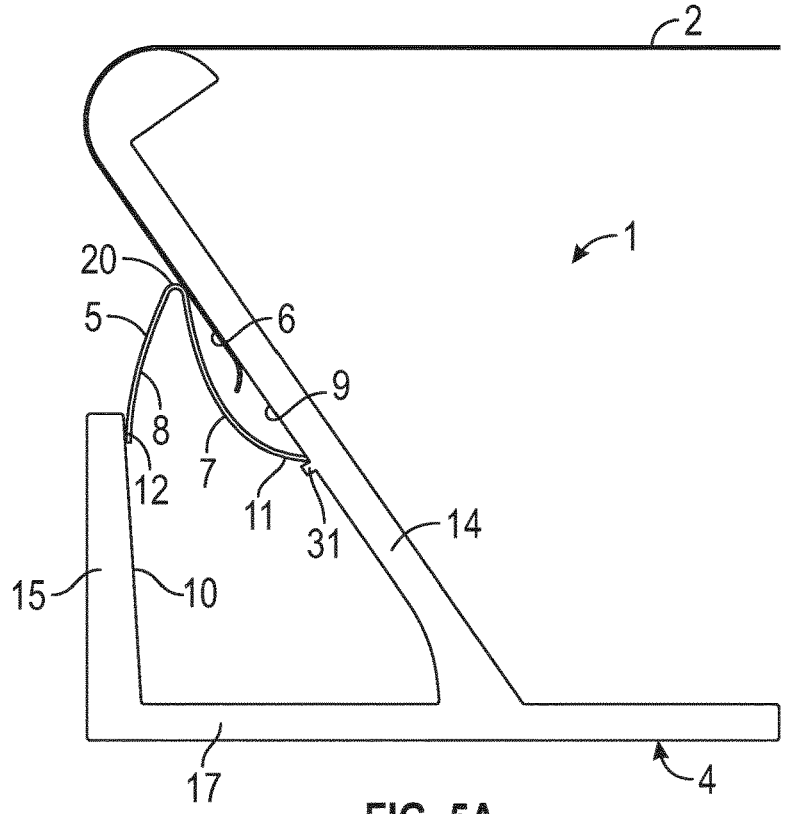
FIGS. 5A and 5B illustrate different steps of the mounting procedure whereby a fabric may be extended by means of a third embodiment of the fabric mounting system according to the invention.
Figure 5B:
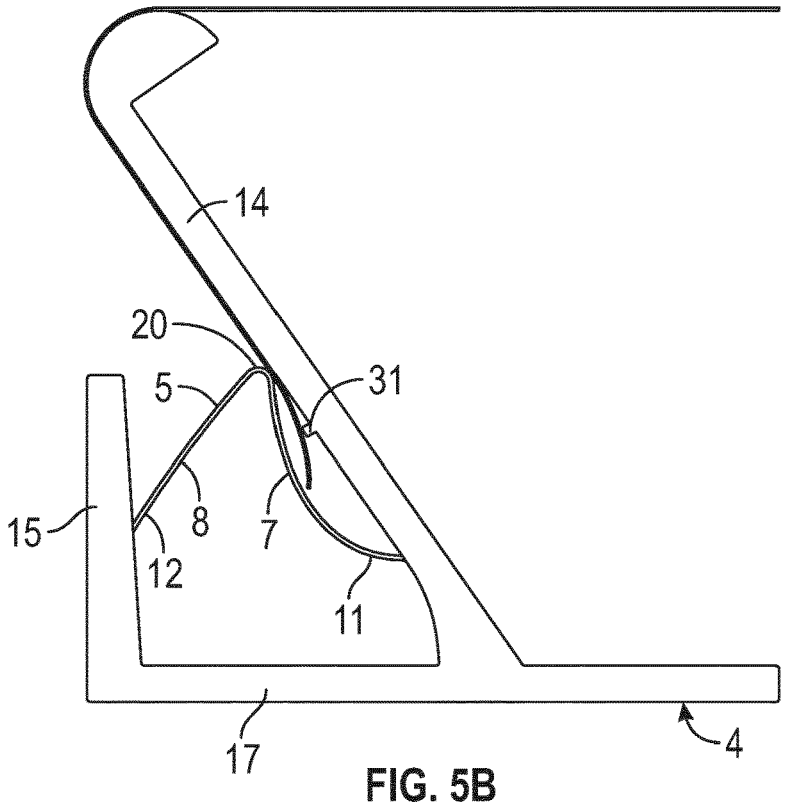

In the embodiment illustrated in FIGS. 5A and 5B, the first fabric retaining element 5 is releasably retained in the fabric attachment position in that a free end 11 of the first leg 7 of the first fabric retaining element 5 abuts a protrusion 31 from the first side wall 14 of the channel 16 of the first mounting profile 4.

In the embodiments illustrated in FIGS. 1 to 6, it is seen that the first side wall 14 of the channel 16 forms an acute angle A in relation to the bottom wall 17 of the channel 16.

In the embodiments illustrated in FIGS. 1 to 6, it is seen that the first fabric retaining element 5 is substantially V-formed and forms a bent edge 20 connecting its first and second legs 7, 8. In the embodiments illustrated in FIGS. 1 to 5, it is seen that the bent edge 20 of the first fabric retaining element 5 points out of the channel 16 of the first mounting profile 4, that is, in the tapering direction T illustrated in FIG. 1. In the embodiment illustrated in FIG. 6, it is seen that the bent edge 20 of the first fabric retaining element 5 points into the channel 16 of the first mounting profile 4, that is, opposite the tapering direction T.

In the embodiments illustrated in FIGS. 1 to 4 and 6, it is seen that both the bent edge 20 and a free end 11 of the first leg 7 abut the first supporting face 9 of the first mounting profile 4 and thereby are adapted to pinch the first edge 6 of the fabric 2 against the first supporting face 9, and that a free end 12 of the second leg 8 abuts the second supporting face 10 of the first mounting profile 4.

In the embodiment illustrated in FIGS. 5A and 5B, it is seen that both the bent edge 20 and a free end 11 of the first leg 7 abut the first supporting face 9 of the first mounting profile 4, and that a free end 12 of the second leg 8 abuts the second supporting face 10 of the first mounting profile 4. However, in the situation illustrated, only the bent edge 20 pinches the first edge 6 of the fabric 2 against the first supporting face 9. This is in order for the free end 11 of the first leg 7 to better abut the protrusion 31.

In the embodiments illustrated in FIGS. 1 to 5, it is seen that the fabric tensioning direction F is directed at least substantially from the bent edge 20 in the direction of the free end 11 of the first leg 7. Furthermore, in these embodiments, the first leg 7 of the first fabric retaining element 5 is curved 21 away from the first supporting face 9 of the first mounting profile 4 between its free end 11 and the bent edge 20, and the first leg 7 of the first fabric retaining element 5 is longer than the second leg 8 of the first fabric retaining element 5. Furthermore, in these embodiments, the second leg 8 of the first fabric retaining element 5 is curved 22 away from the second supporting face 10 of the first mounting profile 4 between its free end 12 and the bent edge 20.

As best seen in FIG. 2, the at least one first fabric retaining element 5 may advantageously have the form of a leaf spring 23 having a longitudinal direction I extending in the longitudinal direction L of the first mounting profile 4. In this embodiment, the first fabric retaining element 5 has a first longitudinal flange 24 forming the first leg 7 and a second longitudinal flange 25 forming the second leg 8, and the first longitudinal flange 24 and the second longitudinal flange 25 are connected along a bent edge 26. Preferably, a number of mutually spaced cut-outs 27 are formed in the bent edge 26 of the leaf spring 23. Thereby, in particular in the case that the leaf spring is relatively long, the cut-outs 27 may impart a certain flexibility to the leaf spring 23, thereby facilitating the release of the leaf spring from its fabric attachment position, for instance by pressing the first longitudinal flange 24 in the direction of the second longitudinal flange 25 so that the first longitudinal flange jumps out of abutment with a suitable recess in the first mounting profile, such as the recess 13 illustrated in FIG. 1. An ability of the leaf spring 23 to twist about its longitudinal axis may advantageously facilitate this operation. The first mounting profile 4 may be formed from any suitable material in any suitable way. The cut-outs 27 may also serve to facilitate removal of the leaf spring 23 from the first mounting profile 4 in that a suitable tool may be inserted into one or more cut-outs 27. For instance, the first mounting profile 4 may be an extruded aluminium profile.

Figure 3C:
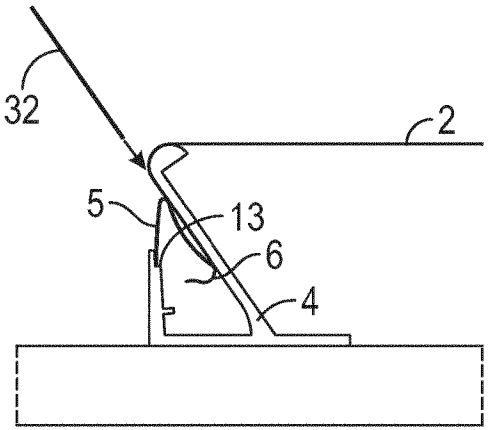
Figure 3D:
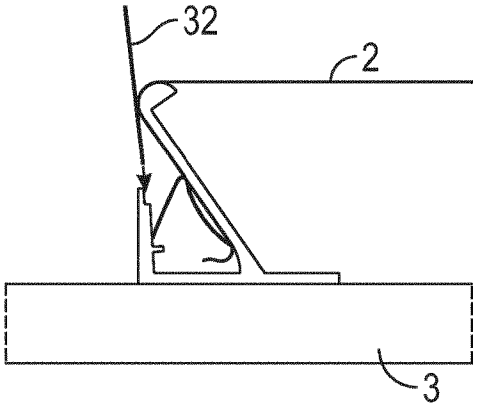

The fabric mounting system illustrated in FIGS. 1 to 3 may be mounted on a wall or ceiling and used to extend a fabric 2 as illustrated in the different steps of FIGS. 3A to 3D. Firstly, as illustrated in FIG. 3A, at least a first mounting profile 4 is mounted on the wall or ceiling as explained above. The first fabric retaining element 5 may be inserted into engagement in the channel 16 of the first mounting profile 4 in the fabric attachment position as explained above and illustrated in FIG. 3B, if it has not already been provided arranged in the channel 16. As illustrated in FIG. 3C, the first edge 6 of the fabric 2 may be pressed in between the first leg 7 of the first fabric retaining element 5 and the first supporting face 9 of first mounting profile 4 by means of a suitable tool, such as a spatula 32. Thereby, when removing the spatula 32, the first edge 6 of the fabric 2 may be pinched an thereby retained between the first leg 7 of the first fabric retaining element 5 and the first supporting face 9 of first mounting profile 4. Subsequently, as illustrated in FIG. 3D, by means of the spatula 32 or other tool, the free end 12 of the second leg 8 of the first fabric retaining element 5 may be pressed out of engagement with the recess 13 of the second side wall 15 of the channel 16. Thereby, the resilient bias of the first and second legs 7, 8 of the first fabric retaining element 5 urges the first fabric retaining element 5 to slide along the first and the second supporting faces 9, 10 in a fabric tensioning direction F as illustrated in FIG. 1 and being transverse to the longitudinal direction L of the first mounting profile 4 so that the fabric 2 is stretched.

It should be noted that although in the examples described above and illustrated, the first fabric retaining element 5 is V-formed or U-formed, it may also have other suitable forms. For instance, the first and second legs 7, 8 may be connected to each other at both their ends, so that a closed form is created. As an example, the first and second legs 7, 8 could each form a half part of a tube, whereby the tube may have for instance a circular or an oval cross-section.

Furthermore it should be noted that in the embodiments illustrated in FIGS. 1 to 6, an insertion direction may be defined for the insertion of the first fabric retaining element 5 into the channel 16 of the first mounting profile 4. This insertion direction may generally be directed more or less in the fabric tensioning direction F and/or oppositely the tapering direction T as defined in FIG. 1.

LIST OF REFERENCE NUMBERS

A acute angle between first side wall and bottom wall of channel
F fabric tensioning direction
L longitudinal direction of first mounting profile
I longitudinal direction of leaf spring
T tapering direction
1 fabric mounting system
2 fabric
3 wall or ceiling
4 first mounting profile
5 first fabric retaining element
6 first edge of fabric
7 first leg of first fabric retaining element
8 second leg of first fabric retaining element
9 first supporting face of first mounting profile
10 second supporting face of first mounting profile
11 free end of first leg of first fabric retaining element
12 free end of second leg of first fabric retaining element
13 recess of first mounting profile
14 first side wall of channel
15 second side wall of channel
16 channel of first mounting profile
17 bottom wall of channel
18 rounded edge of first side wall of channel
19 free edge of first side wall
20 bent edge of first fabric retaining element
21 curve of first leg of first fabric retaining element
22 curve of second leg of first fabric retaining element
23 leaf spring
24 first longitudinal flange of leaf spring
25 second longitudinal flange of leaf spring
26 bent edge of leaf spring
27 cut-out
28 protrusion from second side wall of channel
29 mounting hole in first mounting profile
30 bent-out flap of second leg of first fabric retaining element
31 protrusion from first side wall of channel
32 spatula
33 leg-connecting part of first fabric retaining element
34 mounting part of first mounting profile

The invention claimed is:

1. A fabric mounting system (1) adapted to extend a fabric (2) covering at least a part of a wall or ceiling (3), including at least a first mounting profile (4) having a longitudinal direction (L) and being adapted to be mounted to the wall or ceiling (3) and at least one first fabric retaining element (5) engaging the first mounting profile (4) and being adapted to retain a first edge (6) of the fabric (2), the first fabric retaining element (5) having a first leg (7) and a second leg (8) being resiliently biased in relation to each other so that the first leg (7) is urged against a first supporting face (9) of a first side wall (14) of the first mounting profile (4) and the second leg (8) is urged against a second supporting face (10) of a second side wall (15) of the first mounting profile (4), characterised in that the first and second side walls (14, 15) extend from a bottom wall (17) toward each other to form a channel (16) having a channel opening, the channel opening extending between the first side wall (14) and the second side wall (15) and positioned opposite the bottom wall (17), the first and the second supporting faces (9, 10) of the first mounting profile (4) are mutually tapered in such a tapering direction (T) that the resilient bias of the first and second legs (7, 8) of the first fabric retaining element (5) urges the first and second legs (7, 8) to slide along the first and the second supporting faces (9, 10), respectively, to thereby displace the first fabric retaining element in a direction away from the channel opening, generally against the tapering direction (T), and in a fabric tensioning direction (F), being transverse to the longitudinal direction (L) of the first mounting profile (4) in order to stretch the fabric (2) in its retained position.

2. A fabric mounting system according to claim 1, wherein the first fabric retaining element (5) is displaceable in a direction generally against the tapering direction (T) from a fabric attachment position in which the first fabric retaining element (5) is releasably retained in the first mounting profile (4) to a fabric tensioning position in which the force of the tensioned fabric (2) in the retained position of the fabric balances the resilient bias of the first and second legs (7, 8) of the first fabric retaining element (5) which urges the first fabric retaining element (5) to slide in the direction generally against the tapering direction and in the fabric tensioning direction (F).

3. A fabric mounting system according to claim 2, wherein the first fabric retaining element (5) is releasably retained in the fabric attachment position in that a free end (11, 12) of the first or the second leg (7, 8) of the first fabric retaining element (5) abuts a recess (13) of the first mounting profile (4).

4. A fabric mounting system according to claim 1, wherein the first fabric retaining element (5) is adapted to retain a first edge (6) of the fabric (2) by pinching the first edge (6) of the fabric (2) between the first fabric retaining element (5) and the first mounting profile (4).

5. A fabric mounting system according to claim 1, wherein the first fabric retaining element (5) is adapted to retain a first edge (6) of the fabric (2) by pinching the first edge (6) of the fabric (2) between the first or the second leg (7, 8) of the first fabric retaining element (5) and the corresponding first or second supporting face (9, 10) of the first mounting profile (4).

6. A fabric mounting system according to claim 1, wherein the first and the second supporting faces (9, 10) of the first mounting profile (4) face each other.

7. A fabric mounting system according to claim 1, wherein the first side wall (14) of the channel (16) extends further away from the bottom wall (17) than the second side wall (15) of the channel (16) and forms a rounded edge (18) adapted to guide the fabric (2) at a free edge (19) of the first side wall (14).

8. A fabric mounting system according to claim 7, wherein the first side wall (14) of the channel (16) forms an acute angle (A) in relation to the bottom wall (17) of the channel (16).

9. A fabric mounting system according to claim 6, wherein the first fabric retaining element (5) is substantially V-formed and forms a bent edge (20) connecting its first and second legs (7, 8), wherein both the bent edge (20) and a free end (11) of the first leg (7) abut the first supporting face (9) of the first mounting profile (4) and thereby are adapted to pinch the first edge (6) of the fabric (2) against the first supporting face (9), and wherein a free end (12) of the second leg (8) abuts the second supporting face (10) of the first mounting profile (4).

10. A fabric mounting system according to claim 9, wherein the fabric tensioning direction (F) is directed at least substantially from the bent edge (20) in the direction of the free end (11) of the first leg (7).

11. A fabric mounting system according to claim 9, wherein the first leg (7) of the first fabric retaining element (5) is curved (21) away from the first supporting face (9) of the first mounting profile (4) between its free end (11) and the bent edge (20).

12. A fabric mounting system according to claim 9, wherein the first leg (7) of the first fabric retaining element (5) is longer than the second leg (8) of the first fabric retaining element (5).

13. A fabric mounting system according to claim 9, wherein the second leg (8) of the first fabric retaining element (5) is curved (22) away from the second supporting face (10) of the first mounting profile (4) between its free end (12) and the bent edge (20).

14. A fabric mounting system according to claim 1, wherein the at least one first fabric retaining element (5) has the form of a leaf spring (23) having a longitudinal direction (I) extending in the longitudinal direction (L) of the first mounting profile (4) and having a first longitudinal flange (24) forming the first leg (7) and a second longitudinal flange (25) forming the second leg (8), and wherein the first longitudinal flange (24) and the second longitudinal flange (25) are connected along a bent edge (26).

15. A fabric mounting system according to claim 14, wherein a number of mutually spaced cut-outs (27) are formed in the bent edge (26) of the leaf spring (23).

16. A method of mounting and extending a fabric (2) covering at least a part of a wall or ceiling (3), the method including the steps of mounting at least a first mounting profile (4) having a longitudinal direction (L) on the wall or ceiling (3) and, pinching a first edge (6) of the fabric (2) between the first fabric retaining element (5) and the first mounting profile (4), the first fabric retaining element (5) engaging the first mounting profile (4) and having a first leg (7) and a second leg (8) being resiliently biased in relation to each other so that the first leg (7) is urged against a first supporting face (9) of a first side wall (14) of the first mounting profile (4) and the second leg (8) is urged against a second supporting face (10) of a second side wall (15) of the first mounting profile (4), characterised in that the first and second side walls (14, 15) extend from a bottom wall (17) toward each other to form a channel (16) having a channel opening, the channel opening extending between the first side wall (14) and the second side wall (15) and positioned opposite the bottom wall (17), wherein the resilient bias of the first and second legs (7, 8) of the first fabric retaining element (5) urges the first fabric retaining element (5) to slide along the first and the second supporting faces (9, 10) in a direction away from the channel opening, generally against the tapering direction (T), and in a fabric tensioning direction (F) being transverse to the longitudinal direction (L) of the first mounting profile (4) so that the fabric (2) is stretched.

* * * * *